US005777255A

United States Patent [19]

Smith, III et al.

[11] Patent Number: 5,777,255

[45] Date of Patent: Jul. 7, 1998

[54] EFFICIENT SYNTHESIS OF MUSICAL TONES HAVING NONLINEAR EXCITATIONS

[75] Inventors: Julius O. Smith, III, Palo Alto; Scott A. Van Duyne, Stanford, both of Calif.

[73] Assignee: Stanford University, Stanford, Calif.

[21] Appl. No.: 850,652

[22] Filed: May 2, 1997

Related U.S. Application Data

[63] Continuation of Ser. No. 438,744, May 10, 1995, abandoned.

[51] Int. Cl.[6] ..... G10H 1/12

[52] U.S. Cl. ..... 84/661; 84/622; 84/DIG. 9

[58] Field of Search ..... 84/661, DIG. 9, 84/621–622, 627, 663

[56] References Cited

U.S. PATENT DOCUMENTS

| | | | |
|---|---|---|---|
| 4,622,877 | 11/1986 | Strong | 84/1.01 |
| 4,683,589 | 7/1987 | Scholz et al. | 381/61 |
| 4,951,144 | 8/1990 | Des Jardins | 358/182 |
| 5,050,217 | 9/1991 | Orban | 381/94 |
| 5,256,830 | 10/1993 | Takeuchi et al. | 84/625 |
| 5,264,658 | 11/1993 | Umeyama et al. | 84/661 |
| 5,286,913 | 2/1994 | Higashi | 84/622 |
| 5,286,915 | 2/1994 | Komano et al. | 84/658 |
| 5,290,969 | 3/1994 | Kobayashi | 84/622 |
| 5,317,104 | 5/1994 | Frost | 84/625 |
| 5,373,098 | 12/1994 | Kitayama et al. | 84/659 |
| 5,438,571 | 8/1995 | Albrecht et al. | 370/94.3 |
| 5,500,486 | 3/1996 | Smith, III | 84/622 |
| 5,587,548 | 12/1996 | Smith, III | 84/659 |
| 5,641,931 | 6/1997 | Ogai et al. | 84/661 |

*Primary Examiner*—William M. Shoop, Jr.
*Assistant Examiner*—Marlon T. Fletcher
*Attorney, Agent, or Firm*—Lumen Intellectual Property Services

[57] ABSTRACT

An efficient digital waveguide synthesizer is disclosed for simulating the tones produced by a non-linearly excited vibrational element coupled to a resonator, such as in a piano. In a preferred embodiment, the synthesizer creates an excitation pulse from a table containing the impulse response of a piano soundboard and enclosure. Alternatively, this excitation pulse can be synthesized by filtering white noise. The excitation pulse is fed into a filter that simulates the collision of the piano hammer and string. Because the hammer-string interaction is nonlinear, the characteristics of this filter vary with the amplitude of the tone produced. The filtered excitation pulse is then fed into a filtered delay line loop which models the vibration of a piano string. Because the excitation pulse already contains the effects of the resonator, the tone produced by the delay line loop does not require additional filtering in order to model the resonator.

20 Claims, 15 Drawing Sheets

EFFICIENT SYNTHESIS OF MUSICAL TONES HAVING NONLINEAR EXCITATIONS

This application is a continuation of application Ser. No. 08/438,744, filed May 10, 1995, now abandoned.

FIELD OF THE INVENTION

This invention relates to methods for digital synthesis of tones, and particularly to computationally efficient digital waveguide techniques for the synthesis of tones that are simulations of musical tones produced by musical instruments, such as pianos, whose waveguide elements are nonlinearly excited.

BACKGROUND OF THE INVENTION

A common method for the digital synthesis of musical tones is waveform or spectrum matching, which includes techniques such as sampling, wavetable, wave-shaping, FM synthesis, and additive/subtractive synthesis. This approach generates tones by processing samples taken from a fixed wavetable containing the waveforms produced by a particular instrument. The pitch of the synthesized note is determined from the frequency of the sample in the wavetable. Although these methods reproduce certain tones well, expensive computational resources are often required to sufficiently process the samples to produce a versatile selection of rich and natural sounds. Moreover, the complex processing is controlled by a large number of parameters that are not intuitively related to the characteristics of particular musical instruments or their tones.

An alternative method for the synthesis of musical tones is digital waveguide filtering. Strings, woodwind bores, horns, and the human vocal tract are examples of acoustic waveguides. Rather than processing tone samples from a fixed wavetable, waveguide filtering simulates the physical vibration of a musical instrument's acoustic waveguide with a "filtered delay loop" consisting of a delay line and one or more filters arranged in a loop. Consequently, the pitch of the synthesized note is determined by the total loop delay, which corresponds to the length of the instrument's waveguide, e.g., the length of a string, or distance to the first open tone whole in a woodwind instrument. The delay line loop is excited with a waveform corresponding, for example, to the plucking of a string. The waveguide filtering technique, therefore, can be distinguished from the waveform or spectrum matching techniques by the fact that the waveguide filter is not normally excited by samples that are substantially related to the pitch of the resulting note. The stored waveforms used in waveguide synthesis, consequently, typically require less memory. In addition, because this method models the physical dynamics of an instrument's waveguide, its operational parameters are easily related to the characteristics of particular musical instruments.

Perhaps the most important advantage of this approach is that simple computational waveguide filtering models can produce some surprisingly rich sounds without requiring expensive computational resources. For example, K. Karplus and A. Strong describe a simple implementation of a plucked string in U.S. Pat. No. 4,649,783 issued Mar. 17, 1987 and in "Digital Synthesis of Plucked-String and Drum Timbres," *Computer Music J.*, vol. 7, no. 2, pp. 43–55, 1983. A simple block diagram of this system is shown in FIG. 1. A noise burst from a noise generator 20 is used to initialize the signal in a delay line 22, thereby simulating the pluck of the string. A simple digital filter 24 in the delay line loop causes high frequency components of the initial signal to decay quickly, leaving lower frequency harmonics which are determined by the length of the delay line. The use of the random noise burst gives each note a unique timbre and adds realistic variation to the tones produced. Although the invention of Karplus and Strong produces surprisingly rich sounds with inexpensive computational resources, its simplicity neglects many subtle features of musical tones and introduces several digital artifacts. Because Karplus and Strong did not recognize their algorithm as a physical modeling synthesis technique, it did not include features related to physical strings that could be added with very little cost.

Various limitations to the above approach of Karplus and Strong were addressed by J. O. Smith in "Techniques for Digital Filter Design and System Identification with Application to the Violin", Ph.D. Dissertation, Elec. Eng. Dept., Stanford University, June 1983, and D. Jaffe and J. O. Smith in "Extensions of the Karplus-Strong Plucked-String Algorithm," *Computer Music J.*, vol. 7, no. 2, pp. 56–69, 1983. Jaffe and Smith used additional computational resources to add more usefulness, realism, and flexibility to the basic approach of Karplus-Strong. For example, the decay rates of high and low harmonics were altered to produce more authentic tones, a dynamics filter was added to give control over the strength of the pluck, and effects due to the stiffness of strings were implemented with an allpass filter.

In addition to the computational expense required to implement subtleties of an instrument's waveguide dynamics, complex filtering is also required to realistically model the resonances in the instrument's body. Since the specific characteristics of an instrument's body determine to a large extent its particular sound, a realistic simulation of the body resonator is very desirable in music synthesis systems. Due to the complexity of the body resonator, however, modeling these resonances using known techniques is very expensive. Moreover, the complete modeling of resonances may include the coupling between the waveguide and the body resonator, the body resonator itself, the air absorption, and the room response.

A novel synthesis technique for dramatically reducing the computational resources required to model resonators is described by J. O. Smith in U.S. Pat. No. 5,500,486 entitled "Physical Model Musical Tone Synthesis System Employing Filtered Delay Loop" issued Mar. 19, 1996 and its continuation-in-part, U.S. patent application Ser. No. 08/300,497, entitled "Musical Tone Synthesis System Having Shortened Excitation Table", filed Sep. 1, 1994, both of which are incorporated herein by reference. FIG. 2 shows a sequence of three block diagrams indicating how the conventional architecture for a synthesis system may be restructured to yield a much simpler system. The conventional architecture, shown at the top of the figure, includes an excitation 26 which drives a string loop 28. The signal from the string loop then enters a resonator 30. The first step in the simplification of this architecture is made possible by the fact that the properties of the resonator and the string are time-invariant and linear. Consequently, the order in which they are performed can be reversed. The resulting commuted system, shown in the middle of the figure, includes an excitation 32 which drives a resonator 34. The signal from the resonator then enters a string loop 36.

The next step in the simplification is to eliminate the resonator by absorbing it into the excitation. Many common excitations, such as a plucked string, are qualitatively impulses. Consequently, the output of a resonator excited by an impulse is simply the impulse response of the resonator.

Since the resonator and excitation are both time-invariant, the dynamics of the resonator can be eliminated entirely and the excitation-resonator pair can be replaced by a single aggregate excitation 38 which consists of a pre-convolution of the excitation with the impulse response of the resonator. This signal excites a string 40 with a signal that implicitly includes the effects of the resonator. Consequently, the necessity for expensive computational resources to implement the effects of the resonator is entirely eliminated.

In spite of the significant advantages provided by the technique of commuting the resonator and convolving its impulse response with the excitation, this technique is limited to plucked and linearly-struck waveguides. In particular, it does not apply to a struck piano string since the hammer-string interaction in a piano requires a nonlinear response for accurate modeling and realistic attacks. Consequently, there is no obvious way the resonator can be commuted and the synthesizer complexity reduced as before. The same difficulties arise in other cases where the excitation is nonlinear, such as with vigorously bowed strings. Realistic synthesis of tones from these instruments, therefore, presently require expensive computational resources in order to implement the effects of the resonator.

OBJECTS AND ADVANTAGES OF THE INVENTION

Accordingly, it is a primary object of the present invention to provide a computationally efficient method for the synthesis of tones produced by musical instruments whose waveguide elements are nonlinearly excited. It is a further object of the invention to provide a method for reducing the computational power required to implement a resonator in a waveguide filtering synthesis system where the excitation of the waveguide is nonlinear. It is another object of the present invention to provide a computationally efficient piano synthesizer.

By reducing the computational resources required to implement the effects of a resonator in nonlinearly excited instruments, the cost of producing synthesizers for such instruments is reduced. Moreover, since computational resources are not consumed by simulating the resonator, they can be used to implement additional features that will further improve the quality of synthesis.

SUMMARY OF THE INVENTION

These objects and advantages are attained by a surprising synthesizer design that permits the commutation of the resonator through an effectively nonlinear filter. The device includes an excitation means for producing an excitation pulse, an excitation filtering means for producing a filtered excitation pulse, and a waveguide simulating means for producing the tone. The properties of the excitation means are determined by the characteristics of the resonator. In one embodiment the excitation means includes an excitation table and a pointer for reading values out of the table to produce the excitation pulse. In another embodiment the excitation means generates the excitation pulse by filtering a repeated segment of the resonator impulse response. In another embodiment the excitation pulse is completely synthesized by filtering white noise.

The response of the excitation filtering means is dependent upon the amplitude of the tone and is therefore effectively nonlinear. In a preferred embodiment, the response becomes shorter as the amplitude of the tone becomes larger. A plurality of such filters may be combined with delay lines to model the reflection excitation pulses. The waveguide simulating means comprises a delay line means and a waveguide filtering means whose response is dependent on the characteristics of the vibrating element. Additional embodiments of the synthesizer include additional filters for simulating high-Q portions of the resonator, and for producing effects such as reverberation, equalization, echo, and flanging.

DETAILED DESCRIPTION

In a preferred embodiment, the method for efficiently synthesizing tones from a nonlinearly excited waveguide is applied to the case of the piano. The excitation of a piano string by a piano hammer is nonlinear because the felt tip of the piano hammer acts like a spring whose spring constant rapidly increases as the felt is compressed against the string. In order for a model of the hammer-string interaction to be authentic, this nonlinear effect can not be ignored. At the same time, in order to take advantage of the computational savings of commutation, a linear and time-invariant model of the hammer-string interaction must be found.

Figure 1:
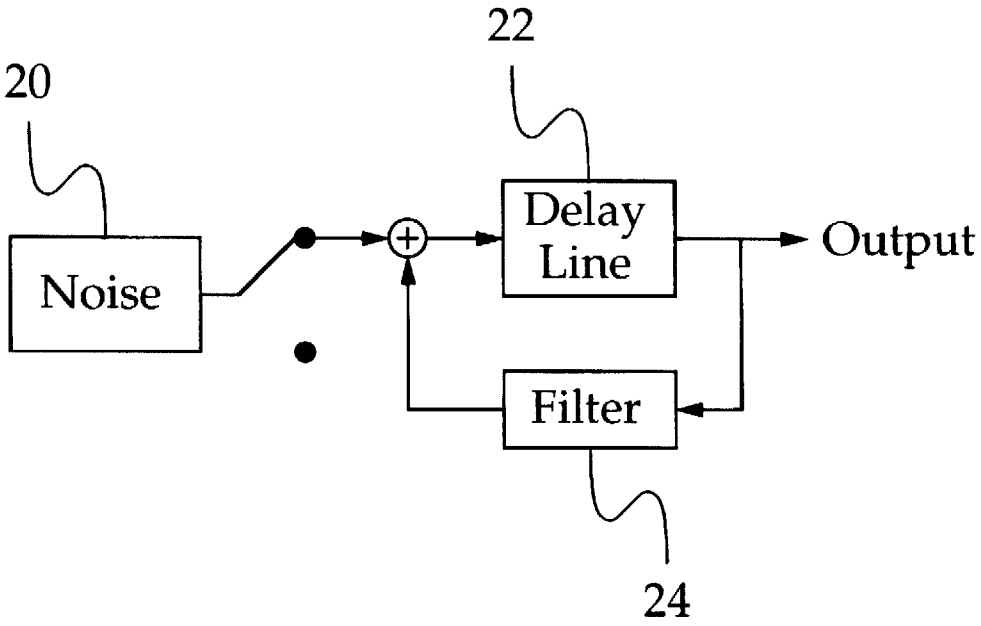
FIG. 1 is a block diagram of a plucked-string synthesizer according to the teaching of Karplus and Strong.
Figure 2:
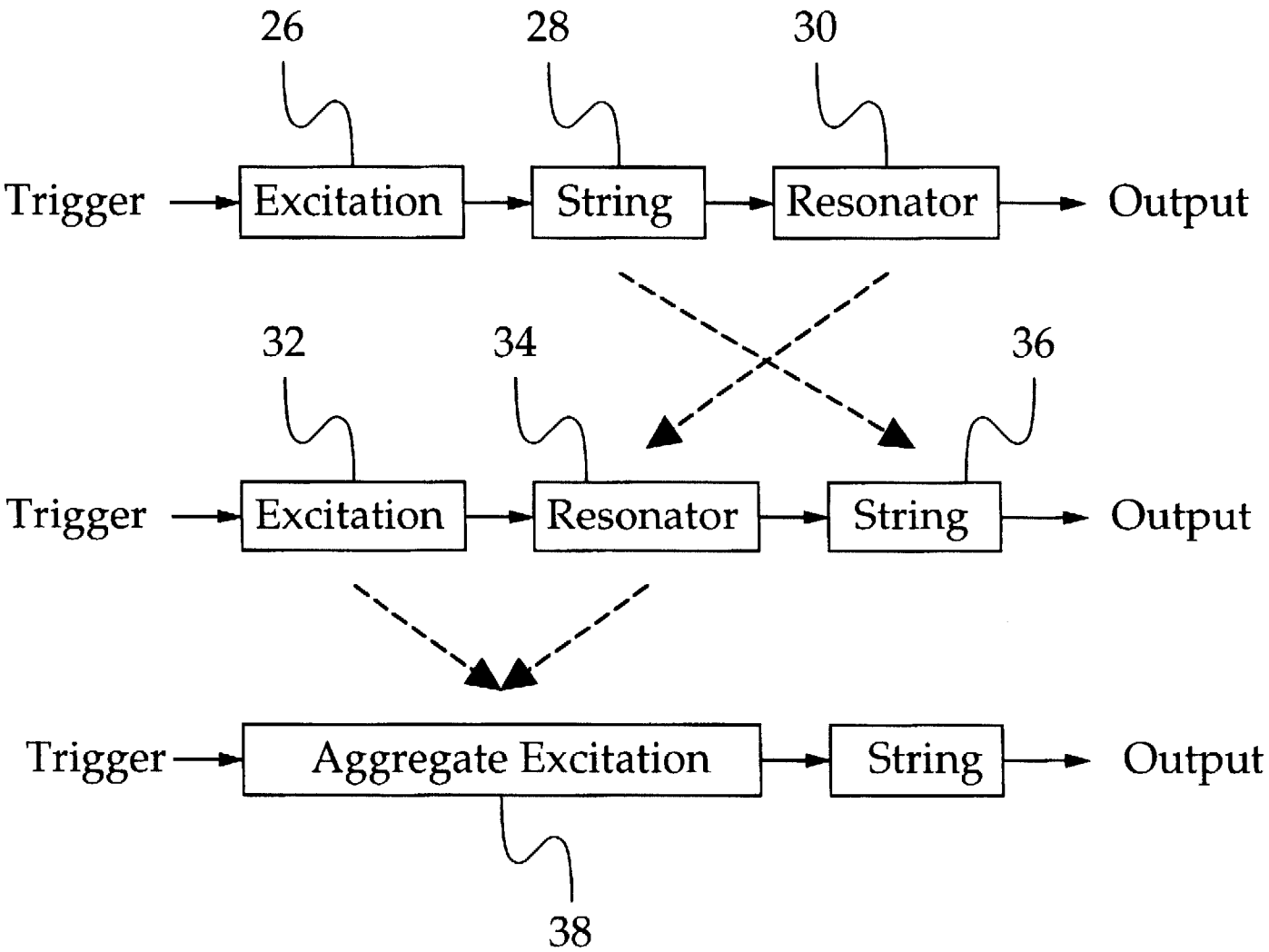
FIG. 2 is an illustration of the technique of J. O. Smith for commuting a resonator through string filters and convolving it with an excitation.
Figure 3:
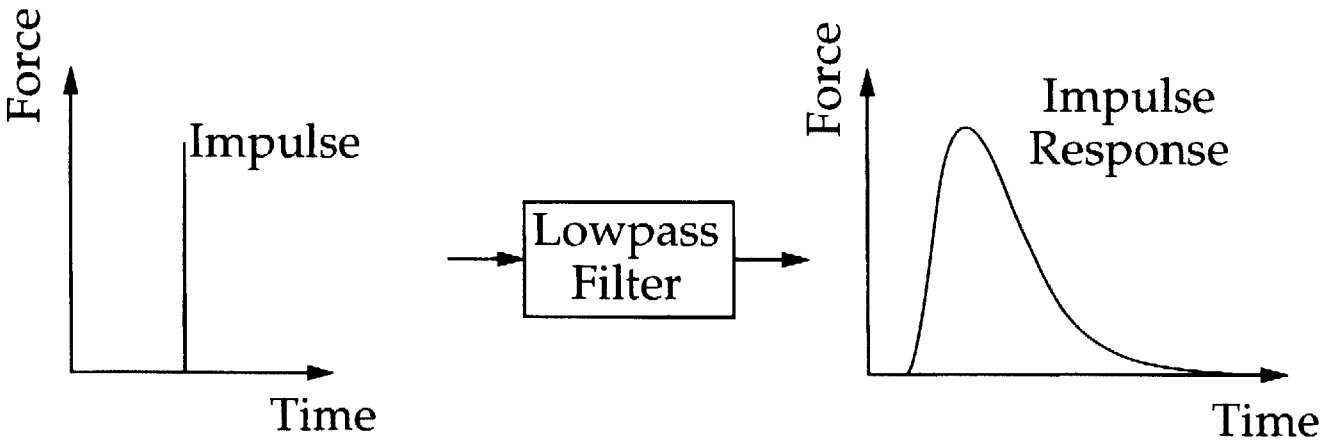
FIG. 3 is an illustration of the modeling of a collision pulse by a filtered impulse, according to the invention.

Because the wave impedance of the string is resistive for an infinitely long string, the hammer will not bounce away from the string until reflected pulses push it away or unless it falls away due to gravity. Consequently, the initial collision pulse can be well modeled by a filtered impulse, as shown in FIG. 3, where the impulse response of the filter corresponds to the compression force signal of a single collision pulse. A fully physical nonlinear computational model of the hammer-string interaction can be used to determine the form of the pulse. Then a linear filter is designed whose response closely approximates this calculated pulse. The form of the force signal is qualitatively similar to the difference of two exponential decays, i.e., $h(t)=A[\exp(-t/\tau_1)-\exp(-t/\tau_2)]$, where $\tau_1>\tau_2$. A filter of the form $H(z)=A(p_1p_2)/[(1-p_1z^{-1})(1-p_2z^{-1})]$ will produce such an impulse response. If desired, the two additional poles can be added to the filter to give a smoother initial rise and a better shock spectrum fit to the calculated compression force signal.

When a piano key is pressed hard and fast, the hammer strikes the string with a high velocity. Because of the nonlinear response of the felt tip, the force pulse is higher and narrower. Consequently, the impulse response of the filter needs to be adjusted in accordance with the hammer velocity so that higher strike velocities will correspond to filters with broader bands, i.e., shorter impulse responses. For example, a simple filter with this property can be designed with a transfer function of the form $H(z)=C/(1-p\,z^{-1})^4$, where p is a monotonic function of the hammer velocity, and C is a constant.

By using a linear filter whose response depends upon the hammer velocity, an effectively nonlinear filter is created. Such a filter, however, is no longer absolutely time-invariant. Nevertheless, since the hammer velocity for each note is a constant, the filter is time-invariant with respect to the synthesis of each note. Thus the resonator can be commuted through the filter and convolved with the excitation.

Figure 4:
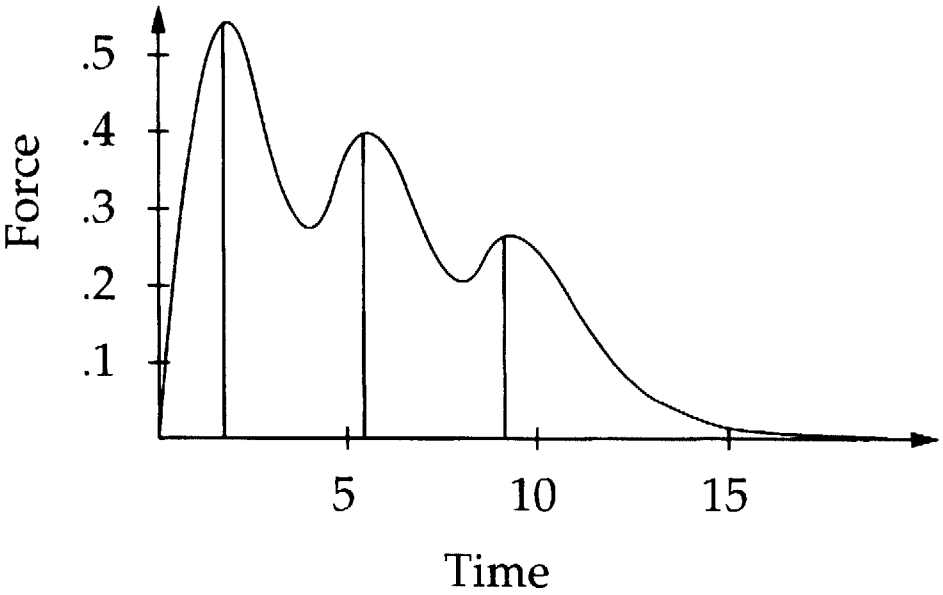
FIG. 4 shows the graph of a collision pulse including an initial pulse and two reflected pulses, according to the invention.
Figure 5:
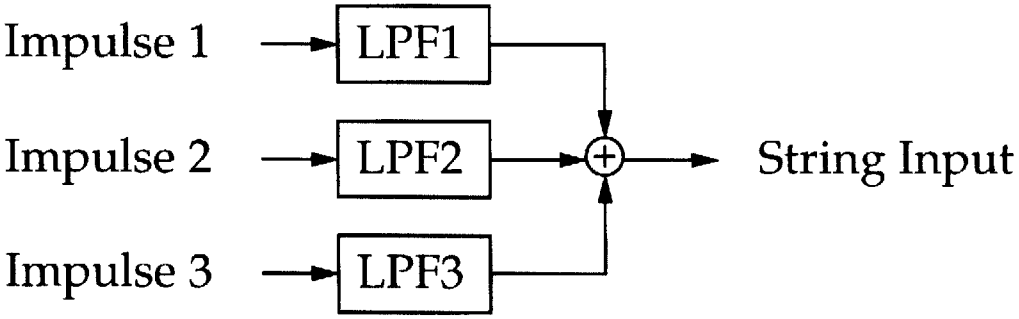
FIG. 5 is a block diagram of a circuit for creating the collision pulse shown in FIG. 4, in accordance with the teachings of the invention.

Because the hammer does not typically bounce off the string immediately after the initial collision pulse, the additional interactions between the hammer and reflected pulses usually must be taken into account. In many cases, the hammer is in contact with the string for a time interval that is long enough for it to interact with several pulses reflected off the near end of the string (the agraffe). For most piano strings, however, the reflected pulses from the far end (the bridge) do not return before the hammer leaves the string. Since the reflected pulses are merely slightly filtered versions of the initial collision pulse, they can also be modeled as filtered impulses. FIG. 4 shows the graph of the interaction including an initial collision pulse and two reflected pulses. FIG. 5 is a block diagram showing one way this hammer-string interaction may be implemented. Three impulses, staggered in time, enter three filters. The signals from the filters are then superimposed and fed into the string. The number of impulses will generally be fixed for a given string. It is also important to note that, since we are assuming that the string is initially at rest, all interaction impulses are predetermined by the initial collision velocity and the string length.

Figure 6:
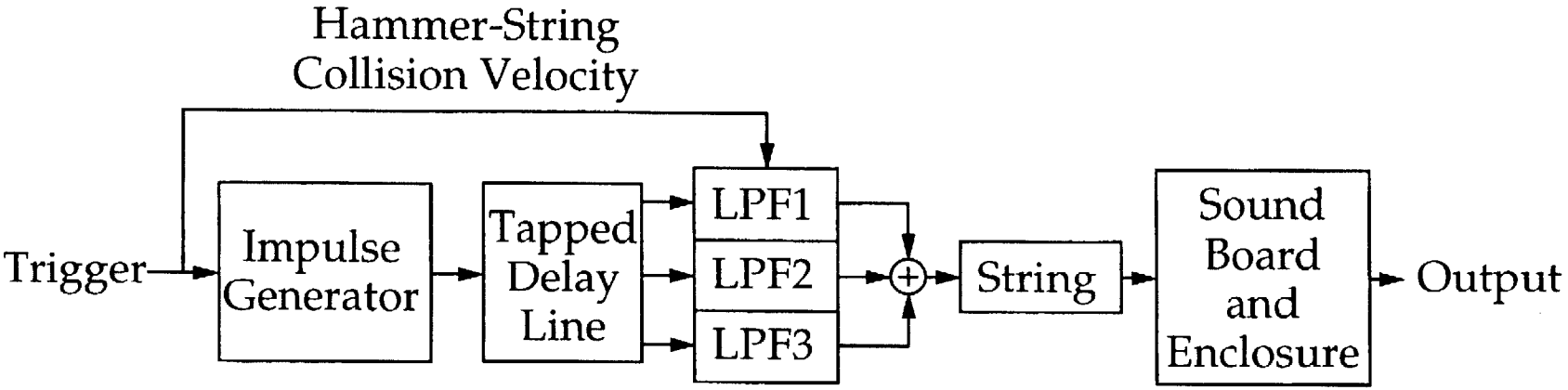
FIG. 6 is a block diagram of a synthesizer of the invention before the resonator is commuted.

The synthesizer, before commuting the sound board and enclosure resonator, is shown in FIG. 6. A trigger signal which contains the hammer velocity information enters the impulse generator and triggers the creation of an impulse. The tapped delay line creates three copies of the impulse, two of which are delayed by differing lengths of time. The three impulses then enter three lowpass filters, LPF1, LPF2, and LPF3, which produce three pulses. Note that the trigger signal is also fed into the three filters in order to adjust their response in accordance with the hammer velocity, thereby producing an effective nonlinear response. The three pulses are superimposed by an adder, and the output of the adder is used to excite a string loop. The output of the string loop then enters the complex sound board and enclosure resonator, which then produces the final output.

Figure 7:
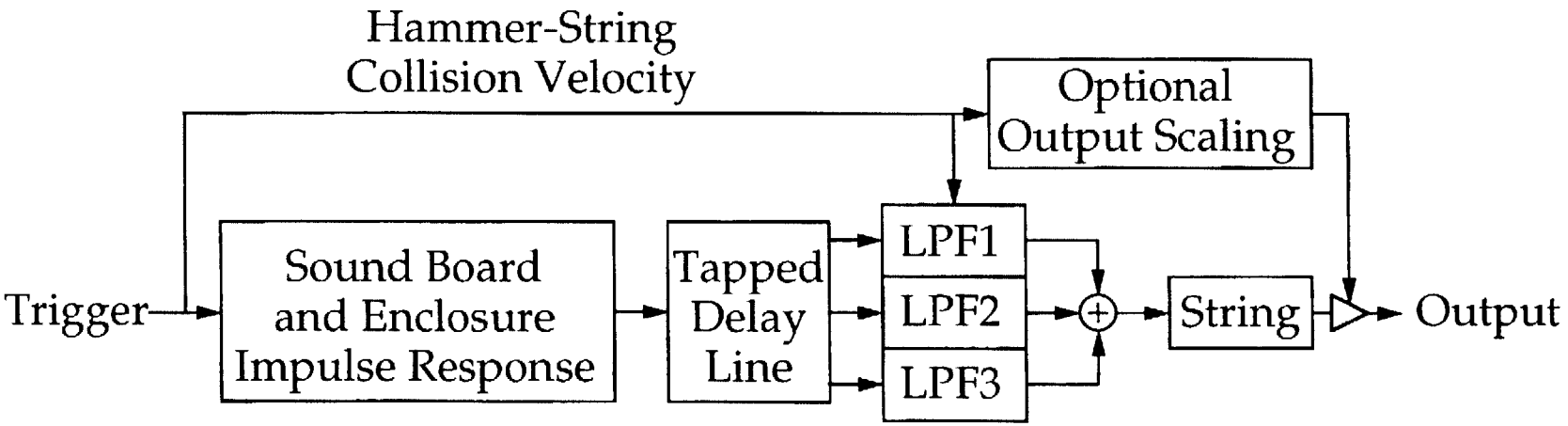
FIG. 7 is a block diagram of a synthesizer of the invention after the resonator is commuted through the filters and convolved with the excitation.

FIG. 7 shows the synthesizer after the sound board and enclosure resonator has been commuted and convolved with the impulse generator. When triggered, the impulse response of the sound board and enclosure passes through the same tapped delay line and interaction pulse filters as in FIG. 6. The resulting signals are added and used to excite the string loop. Since the trigger alters the response of the collision pulse filters, the excitation is effectively nonlinear even though the filters are linear with respect to each note played. Moreover, because the effects of the resonator are built-in to the excitation, the string excitation already includes effects due to the resonator. With the resonator commuted and convolved with the excitation generator, the expensive processing normally required to implement the resonator is entirely eliminated. If desired, an optional output scaling circuit can be included in order to scale the string output in accordance with the hammer velocity.

Figure 8:
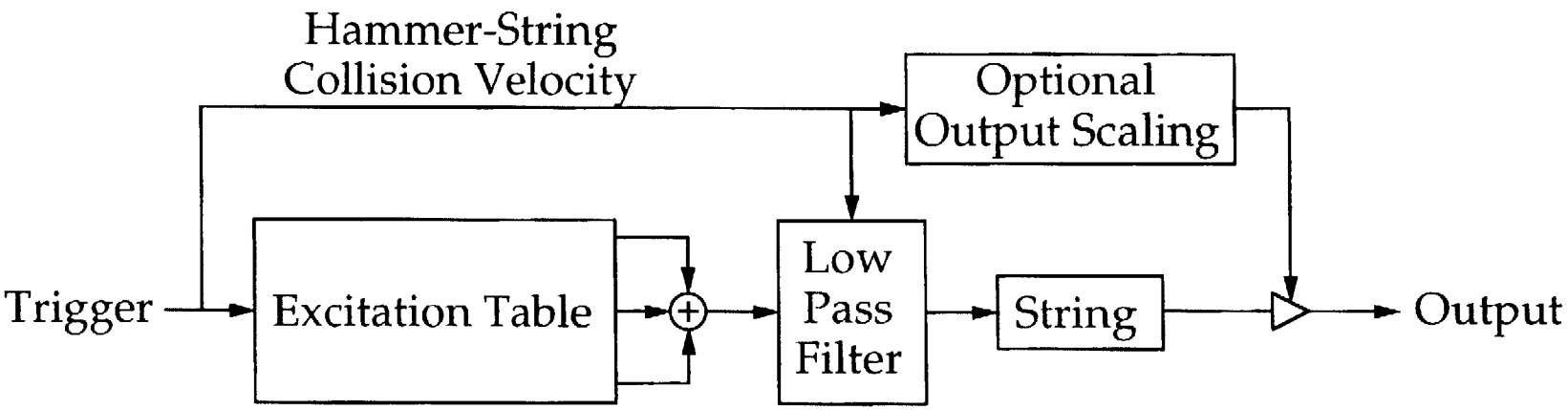
FIG. 8 is a block diagram of a synthesizer of the invention reducing the number of filters used to model the collision pulse.

FIG. 8 shows a slightly different implementation that trades some accuracy in the modeling of the collision pulse for computational efficiency. Because the collision pulse filters are nearly identical, the adder can be commuted and the three filters can be consolidated into one. Rather than implementing the impulse delays with tapped delay lines, this embodiment uses three separate pointers to read the values from the excitation table. Otherwise, the operation of this synthesizer is identical to that described above.

Figure 9:
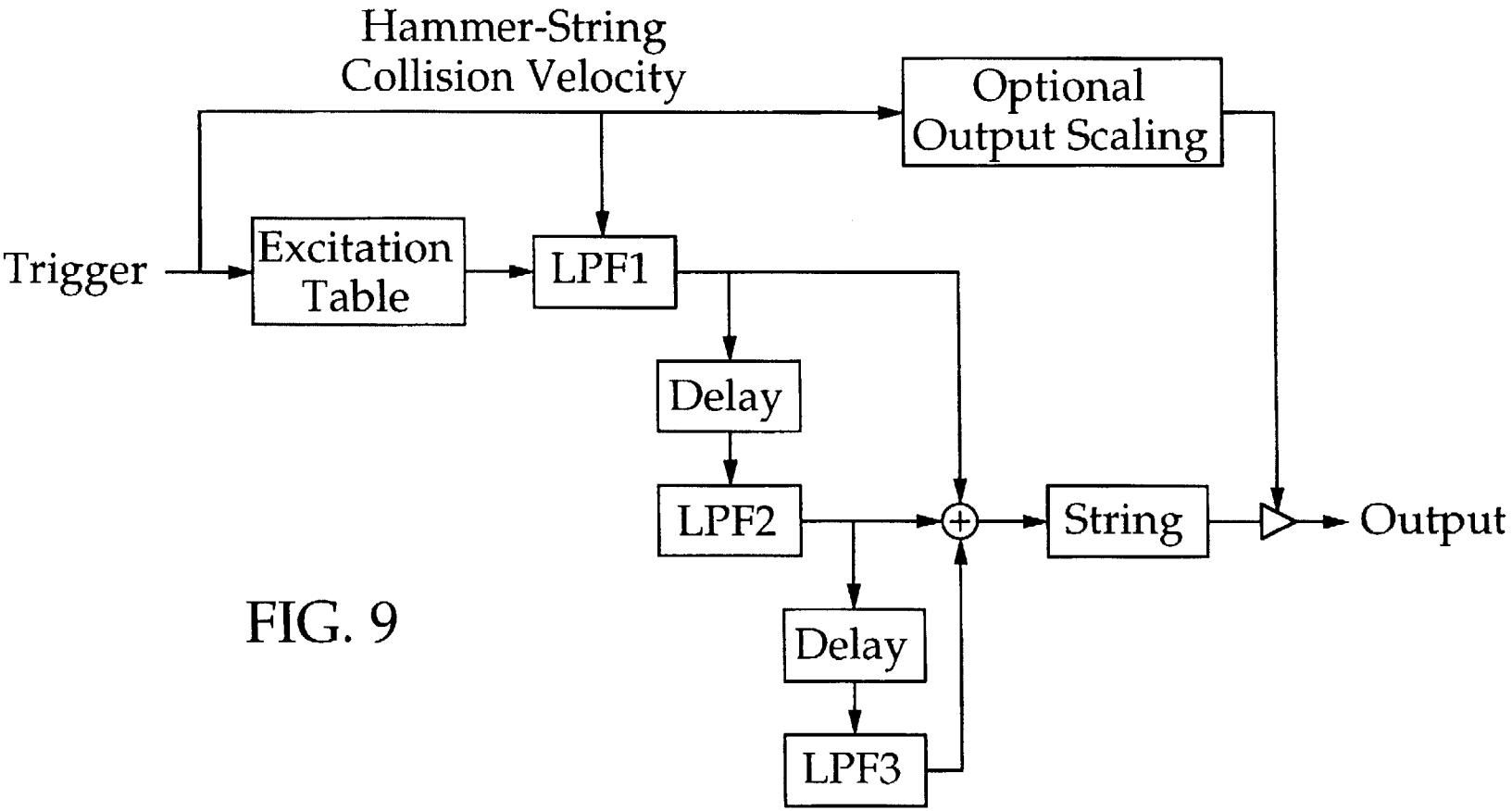
FIG. 9 is a block diagram of a synthesizer of the invention reducing the complexity of the filters used to model the reflected collision pulses.

FIG. 9 shows an alternate embodiment that improves computational efficiency without sacrificing the accuracy of the collision pulse modeling. Since each reflected pulse is smoother than the one preceding it, as long as the hammer remains in contact with the string, the reflected pulse filters can be simplified by using the result of one filter as the input for the next. Since each filter in this embodiment need only provide mild smoothing and attenuation, it is computationally cheap to implement. A further simplification can be made by convolving the impulse response of the first filter at a particular hammer velocity with the excitation. The first filter can then be replaced with a simpler filter that merely modifies the excitation to account for the difference between the preconvolved velocity and the desired velocity.

Figure 10:
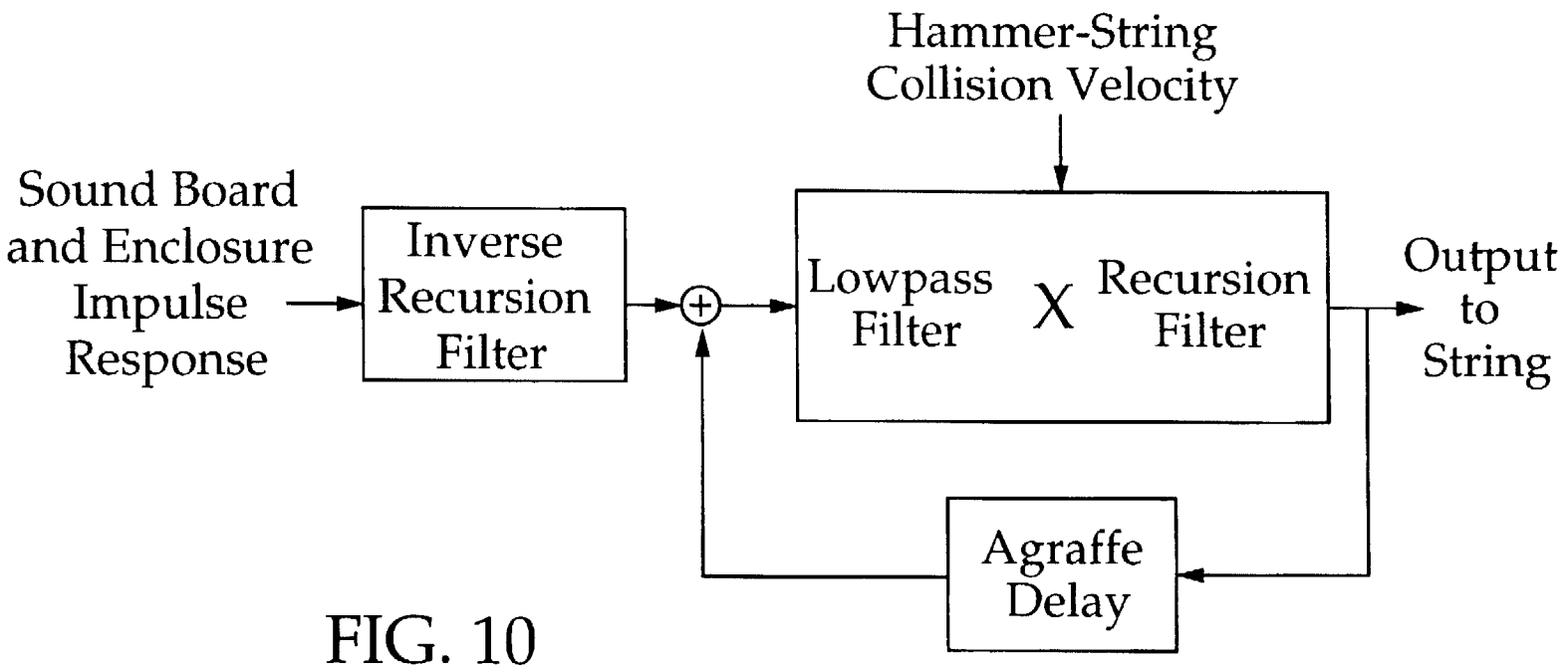
FIG. 10 is a block diagram of a synthesizer of the invention using feedback to model the reflected collision pulses.

In the embodiment shown in FIG. 10, rather than using the above "feedforward" approach to modeling the multiple force pulses of the hammer-string interaction, a "feedbackward" approach is implemented. In this implementation the initial pulse is fed back through a delay and a recursion filter and added to the signal at the input of the collision pulse filter. A simplification of this implementation combines the recursion filter with the collision pulse filter and prefilters the signal entering the feedback loop with an inverse recursion filter.

Figure 11:
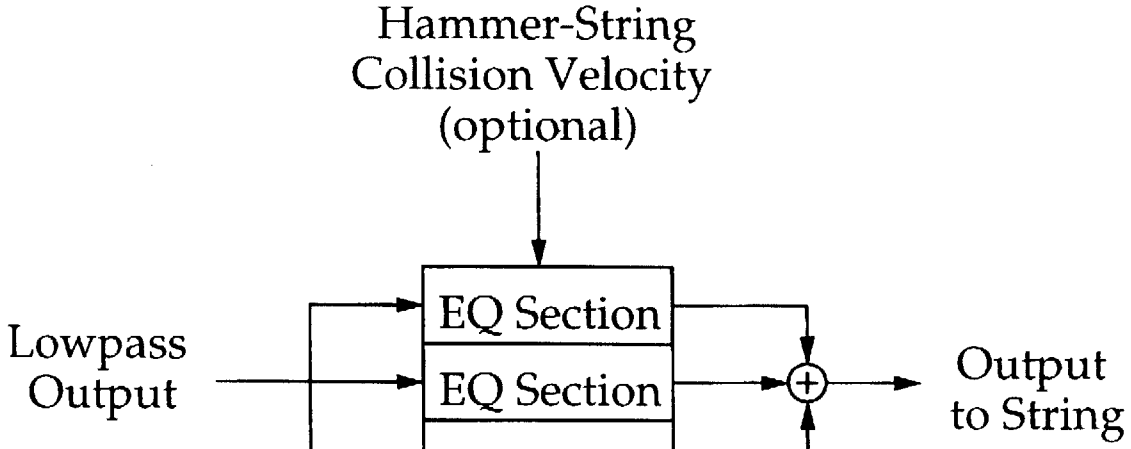
FIG. 11 is a block diagram of a synthesizer of the invention using an equalizer bank to model the reflected collision pulses.

In the embodiment shown in FIG. 11, the multiple collision pulse filtering is performed by an equalizer bank. Using a computational model of the multiple collision force pulse, the ratio spectrum of the multiple pulse spectrum to the single pulse spectrum is modeled by an EQ bank of 2-pole/2-zero filters. Combining this bank with a single collision pulse filter then yields a multiple collision pulse filter.

In a versatile synthesizer, the resonator includes the response of the piano with the pedal down and the response with the pedal up. When the pedal is down, the sound of the strings couples into the whole set of strings attached to the sound board, creating a rich reverberant color change to the piano sound. Whereas the pedal up response lasts less than half a second, the rich pedal down impulse response can last from 10 to 20 seconds and includes the many modes from hundreds of strings. Because such a long impulse response requires so much memory, it is desirable to find ways to reduce the length of the pedal down impulse response.

Figure 12:
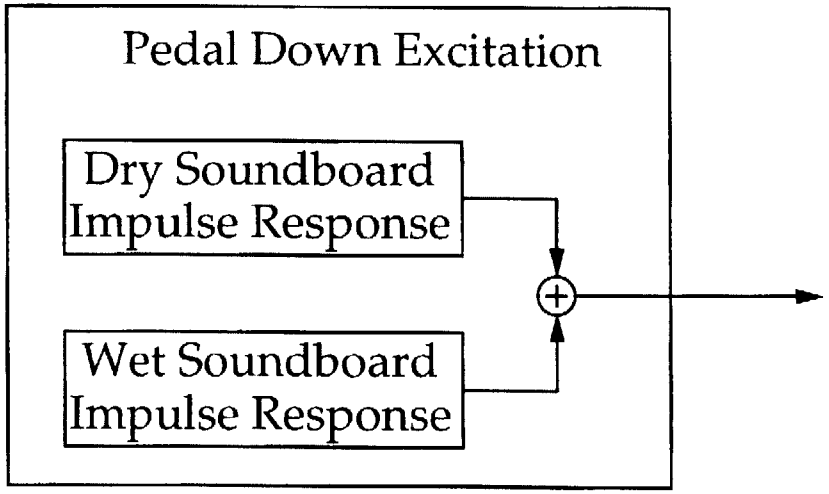
FIG. 12 is a block diagram illustrating the decomposition of the excitation into dry and wet parts, according to the invention.
Figure 13:
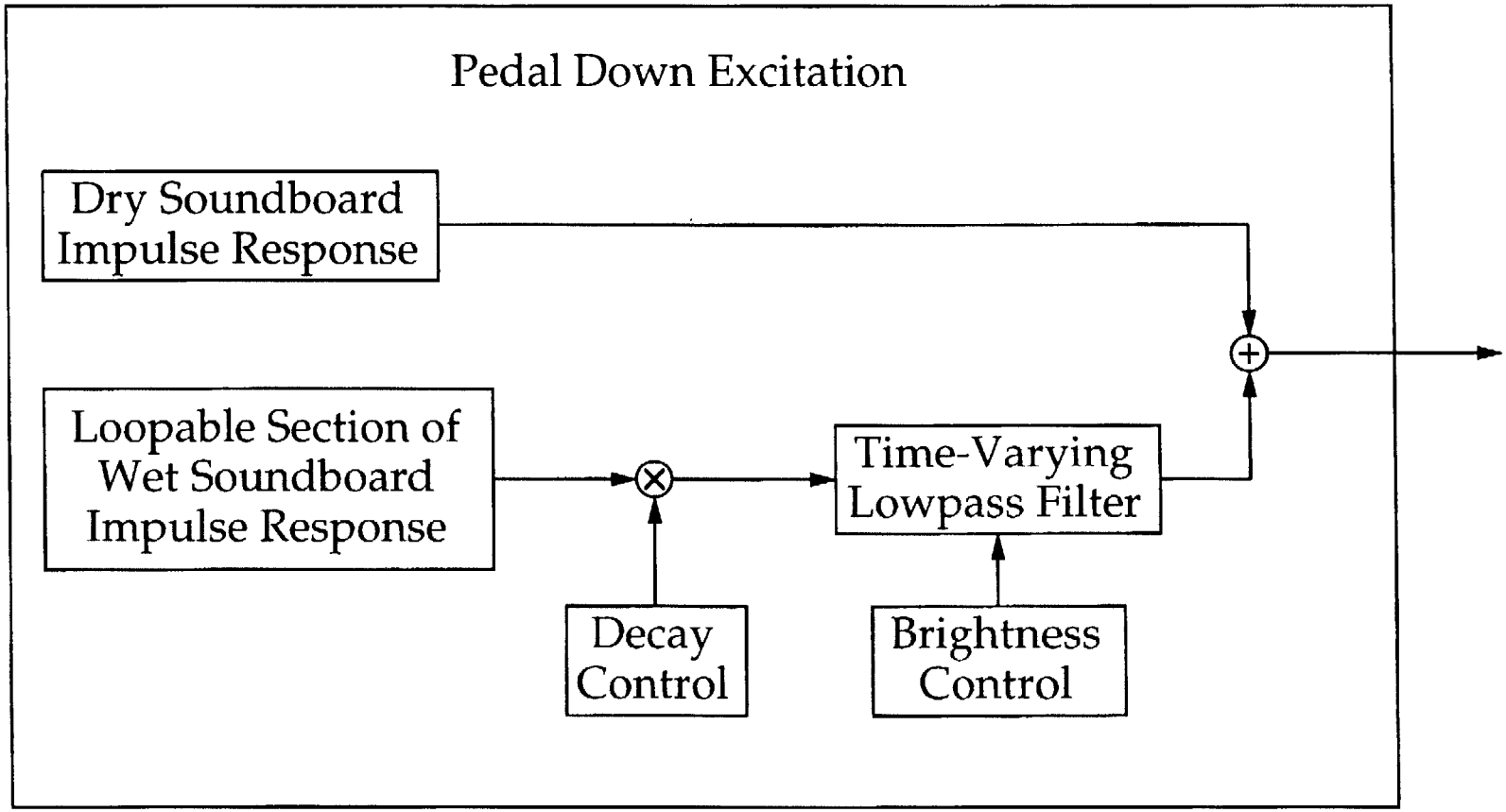
FIG. 13 is a block diagram showing how the wet portion of the soundboard impulse response can be synthesized, according to the invention.

One way to reduce the length of the pedal down impulse response is to decompose the response into two parts, as shown in FIG. 12. The dry part is the impulse response of the soundboard and enclosure with the pedal up. The wet part is the impulse response of just the open strings resonating. The sum of the two is approximately equivalent to the impulse response of the piano with the pedal down. Although this decomposition in itself does not reduce the required memory, once the dry and wet parts have been separated, the wet impulse response can now be shortened by the implementation shown in FIG. 13. It is possible to normalize its amplitude, clip out a representative section of its quasi-steady state, and use a loop to play this section repeatedly. A slow exponential decay amplitude envelope is applied to model the decay rate of the original impulse response, and a slowly time-varying lowpass filter is applied to adjust the decay rates of high and low frequency components. In short, the wet part can be synthesized using any of the well known methods of wavetable synthesis or sampling synthesis.

The following technique provides another method for reducing even further the memory required to store the soundboard impulse response. In a linear approximation, the soundboard impulse response is a superposition of many exponentially decaying sinusoids. Since an ideal piano soundboard does not preferentially couple to any specific notes, its spectral response is very flat (although high frequency modes decay a little faster than low frequency modes). The impulse response of such a system can be modeled as exponentially decaying white noise with a time-varying lowpass filter to attenuate high-frequency modes faster than low-frequency modes. The bandwidth of this filter shrinks as time increases.

This above model can be refined by introducing a simple lowpass filter to more accurately shape the noise spectrum before it is modified dynamically during the playing of a note. In addition, several bandpass filters can be introduced to provide more detailed control over the frequency dependence of the decay rates of the soundboard impulse response. An advantage of this technique is that it provides complete control over the quality of the soundboard. Moreover, using this technique the impulse response of the soundboard can be synthesized without expensive computational resources or large amounts of memory. In general, this technique can be used to synthesize any number of reverberant systems that have substantially smooth responses over the frequency spectrum. The piano soundboard and the soundboard with open strings are both systems of this kind. High quality artificial reverberation devices ideally have this property as well.

In general, when the resonator becomes very complex and has a very long impulse response, it is possible to reduce the length of the stored excitations required by factoring the resonator into two parts and only commuting one of them. Thus computational and memory resources can be interchanged to suit the particular application. For example, it is often profitable to implement the longest ringing resonances of the soundboard and piano enclosure using actual digital filters. This shortens the length of the excitation and saves memory. Note that the resonator may include the resonances of the room as well as those of the instrument.

Figure 14:
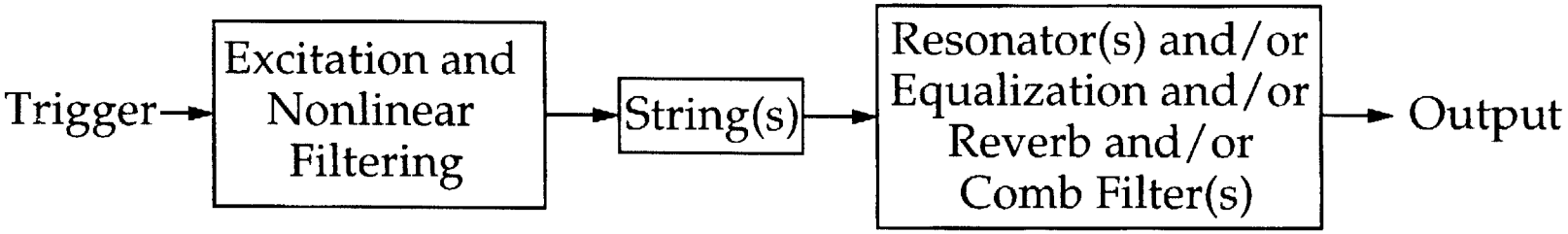
FIG. 14 is a block diagram of an entire synthesizer of the invention including additional filters for supplementary effects.

In addition to the high-Q resonator filters, other filters may also be included in the synthesizer. For example, the synthesizer may include reverberation filters, equalization filters to implement piano color variations, and comb filters for flanging, chorus, and simulated hammer-strike echoes on the string. Since these filters are linear and time-invariant, they may be ordered arbitrarily. A general synthesis system of this type is shown in FIG. 14. Multiple outputs are provided for enhanced multi-channel sound.

For purposes of simplicity, the embodiments above are described for only a single string. Nevertheless, the techniques and methods are generally applicable to any string and can be used to model multiple strings simultaneously. Indeed, the synthesis of realistic piano tones requires the modeling of up to three strings per note and up to three modes of vibration per string corresponding to vertical and horizontal planes of transverse vibration, together with the longitudinal mode of vibration in the string. Coupling between these vibrational modes must also be included in the model. The complete modeling of a piano note, therefore, would require a model with as many as nine filtered delay loops coupled together.

Figure 15:
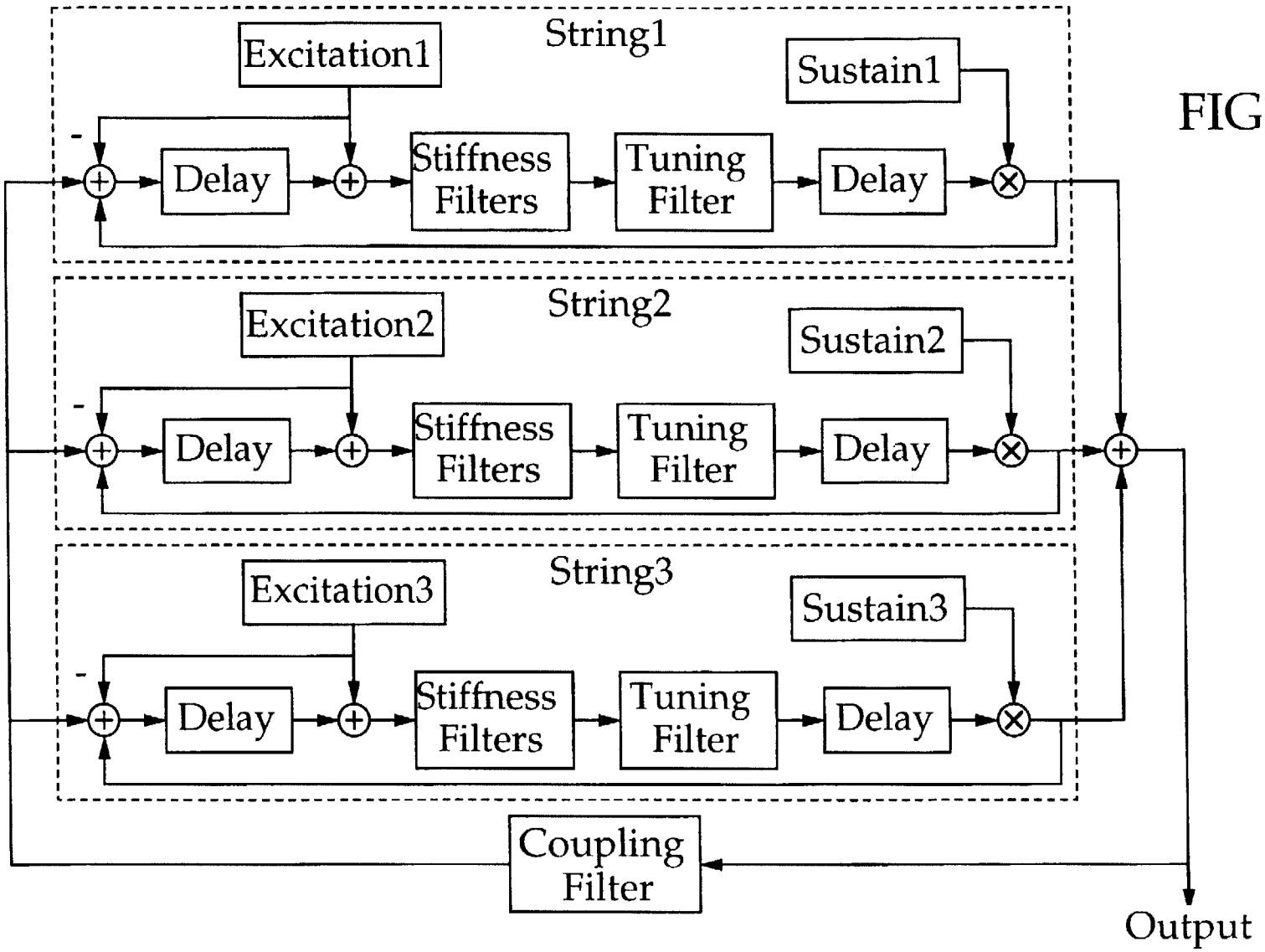
FIG. 15 is a block diagram showing three string loops coupled together to model the three strings of a single piano note.

FIG. 15 shows an implementation of the transverse vibrations of three coupled strings corresponding to a single note. The coupling filter models the loss at the yielding bridge termination and controls the coupling between the three strings. Each string loop contains two delay elements for modeling the round-trip delay from the hammer strike point to the agraffe and the round-trip delay from the hammer strike point to the bridge. For a typical piano string the ratio of these delays is about 1:8. The three string loops are excited by three excitation signals, each of which is produced as described earlier. To model the spectral combing effect of the relative strike position of the hammer on the string, these excitation signals enter their respective string loops at two different points, in positive and negative form. To model una corda pedal effects, one or more of these excitation signals are set to zero at key strike time, causing the coupled string system to quickly progress into its second stage decay rate.

Sustain signals for each string loop in FIG. 15 are set to 1.0 during the sustain portion of the note and are ramped to an attenuation factor, e.g., 0.95, when the key is released. The delay lengths in this coupled string model are fine-tuned with tuning filters such that the effective pitch of the three strings vary slightly from being exactly equal. This slight dissonance between the strings results in the two-stage decay that is a very important quality of piano notes. To model the effect of the natural inharmonicity of the piano string partials, the phase response of the loops are modified by stiffness filters, typically having allpass filter structures.

To permit the playing of several notes at once, a collection of strings as just described are implemented in parallel. The sound of the complete piano is then obtained from the addition of the sounds synthesized for each note. In a complete piano synthesizer such as this, filtering of the tones after the strings The above embodiments are only specific implementations of the invention. Anyone skilled in the art of electronic music synthesis can easily design many obvious variations on and implementations of the above synthesis systems based on the teachings of the invention. Accordingly, the scope of the invention should be determined by the following claims and their legal equivalents.

we claim:

1. A device for electronically synthesizing a tone as physically produced by an excited vibrating element coupled with a resonator, the device comprising:

an excitation means for producing an excitation pulse determined by the characteristics of the resonator;

an excitation filtering means for producing from the excitation pulse a filtered excitation pulse, the excitation filtering means having an impulse response which varies in dependence upon information contained in a trigger signal for the tone; and a waveguide simulating means for simulating the vibrating element and producing the tone, the waveguide simulating means being driven by the filtered excitation pulse and comprising a delay line means and a waveguide filtering means, the waveguide filtering means having a linear impulse response dependent upon the characteristics of the vibrating element.

2. The device of claim 1 wherein the trigger signal comprises a collision velocity for the tone, and wherein the response of the excitation filtering means is linear with respect to a fixed value of the collision velocity and becomes shorter as the collision velocity becomes larger.

3. The device of claim 1 wherein the trigger signal comprises a collision velocity, for the tone, and wherein the excitation filtering means comprises:

a plurality of lowpass filters, at least one of whose impulse response depends upon the collision velocity a delay line for producing a delay in the response of at least one of the lowpass filters, and an adder for producing the filtered excitation pulse from the outputs of the lowpass filters.

4. The device of claim 3 wherein the impulse response of at least one of the lowpass filters is substantially equal to the difference of two exponential decaying signals.

5. The device of claim 1 wherein the excitation filtering means comprises a delay means and a recursion filtering means in a feedback loop.

6. The device of claim 1 wherein the excitation filtering means comprises an equalizer bank and a single hammer-string collision pulse filter.

7. The device of claim 1 wherein the excitation means comprises an excitation table and a pointer for reading values in the excitation table to produce the excitation pulse.

8. The device of claim 7 wherein the excitation table contains an impulse response including that of a piano soundboard.

9. The device of claim 7 wherein the excitation table contains an impulse response including that of a piano soundboard coupled to open strings.

10. The device of claim 7 wherein the excitation table contains an impulse response including that of a piano enclosure.

11. The device of claim 7 wherein:

the trigger signal comprises a collision velocity for the tone;

the excitation means comprises a delayed pointer for reading delayed values in the excitation table and an adder for adding the delayed values to the excitation pulse, and the excitation filtering means comprises a lowpass filter whose impulse response depends upon the collision velocity.

12. The device of claim 1 wherein the excitation means comprises:

a white noise generator for generating a white noise signal, a decay envelope means for causing an amplitude of the white noise signal to decay to a value substantially close to zero after a finite time interval, and a noise filtering means to filter the white noise signal, the noise filtering means having a frequency and amplitude response that is time-varying.

13. The device of claim 12 wherein the noise filtering means has a bandwidth that decreases with time.

14. The device of claim 12 wherein the decay envelope means causes the amplitude of the white noise to exponentially decay.

15. The device of claim 1 wherein the excitation means comprises:

a dry response generating means for producing a dry impulse response, a wet response generating means for producing a wet impulse response, and an adder for combining the dry impulse response and the wet impulse response to produce the excitation pulse.

16. The device of claim 15 wherein the wet response generating means comprises:

an excitation table containing a section of a normalized impulse response of a piano soundboard coupled to open strings, a pointer for reading values in the excitation table to produce the excitation pulse, an exponential decay envelope generator to scale the amplitude of the excitation pulse, and a slowly time-varying lowpass filter to adjust the decay rates of high and low frequency components of the excitation pulse.

17. The device of claim 1 further comprising an output scaling means for scaling the amplitude of the tone.

18. The device of claim 1 further comprising a filtering means for filtering the tone produced by the waveguide simulating means.

19. The device of claim 18 wherein the filtering means simulates high-Q portions of the resonator.

20. The device of claim 18 wherein the filtering means produces an effect chosen from the group consisting of a reverberation effect, an equalization effect, an echo effect, and a flanging effect.

* * * * *